United States Patent [19]

Stadeker

[11] 3,975,785

[45] Aug. 24, 1976

[54] LIFE PRESERVER BATON

[76] Inventor: Carl Stadeker, 11001 S. Parnell, Chicago, Ill. 60628

[22] Filed: Mar. 3, 1975

[21] Appl. No.: 555,200

Related U.S. Application Data

[63] Continuation-in-part of Ser. No. 467,296, May 6, 1974, abandoned.

[52] U.S. Cl. ..... 9/319

[51] Int. Cl.[2] ..... B63C 9/16

[58] Field of Search ..... 9/14, 316, 323, 324, 9/319, 320, 318, 345, 317; 222/5

[56] References Cited

UNITED STATES PATENTS

| | | | |
|---|---|---|---|
| 2,463,641 | 3/1949 | Podell | 9/316 |
| 2,786,599 | 3/1957 | Higbee | 222/5 |
| 3,048,860 | 8/1962 | Richardson | 9/345 X |
| 3,350,730 | 11/1967 | Kubit et al. | 9/317 |

*Primary Examiner*—Stephen G. Kunin
*Assistant Examiner*—Gregory W. O'Connor
*Attorney, Agent, or Firm*—Alter and Weiss

[57] ABSTRACT

An elongated cylindrical life preserver baton has a top which may be unscrewed and removed to free a flotation collar, which is simultaneously inflated by gas housed in a container within the bottom of the baton. When the baton top is removed, a spike housed in the neck of the baton pierces the frangible seal of the gas container.

11 Claims, 6 Drawing Figures

LIFE PRESERVER BATON

This is a continuation-in-part, of my application Ser. No. 467,296, filed May 6, 1974, entitled LIFE PRESERVER BATON, now abandoned.

This invention relates to aquatic life saving equipment and more particularly to a life preserver baton with a flotation device that is released by simply unscrewing and removing the baton top.

Life preservers heretofore have been designed as rings, jackets, or pillows, often filled with cork or similar material. These life preservers have had limited use because they are bulky, complicated, inconvenient, and often expensive. Due to the nature of a voyage, it has sometimes been desirable to wear the life preservers throughout an entire journey. Sometimes it is necessary to throw the preserver to a person floundering in the water during an emergency. Some devices have been developed which can be fired from a gun, and others have been developed which have automatic means for inflation when the person wearing them comes in contact with water. However, these devices are either too cumbersome or too costly or they require special instructions for proper operation.

Accordingly, an object of this invention is to provide an inexpensive easily inflatable life preserver.

A further object is to provide a lightweight device which can be easily carried or pinned to one's clothing, and can be used without unpinning.

Another object is to provide a device which can be easily and accurately thrown or transported to a person in need, will float, and does not require special tools or complicated instructions to use.

Yet another object is to provide a life preserver baton which can be inflated automatically by gas under pressure within a container in one of the baton sections.

In keeping with one aspect of the invention, an inventive life preserver baton is an elongated cylindrical device with a top which can be unscrewed and removed. When unscrewed, the top frees a previously deflated and folded flotation collar held within the baton top. The collar is inflated by gas under pressure housed in the bottom of the device. Initially, the gas is held within a container, which is sealed at its neck by a frangible material, and which is pierced by a nail responsive to the removal of the baton top. The gas is then released from the container to inflate the flotation collar as it escapes from its folded position inside the top. The invention provides a fast, effective and inexpensive aquatic life preserver.

The above-mentioned and other features of this invention and the manner of obtaining them will become more apparent, and the invention itself will be best understood by reference to the following description of the preferred embodiment of the invention taken in conjunction with the accompanying drawings, in which.

Figure 1:
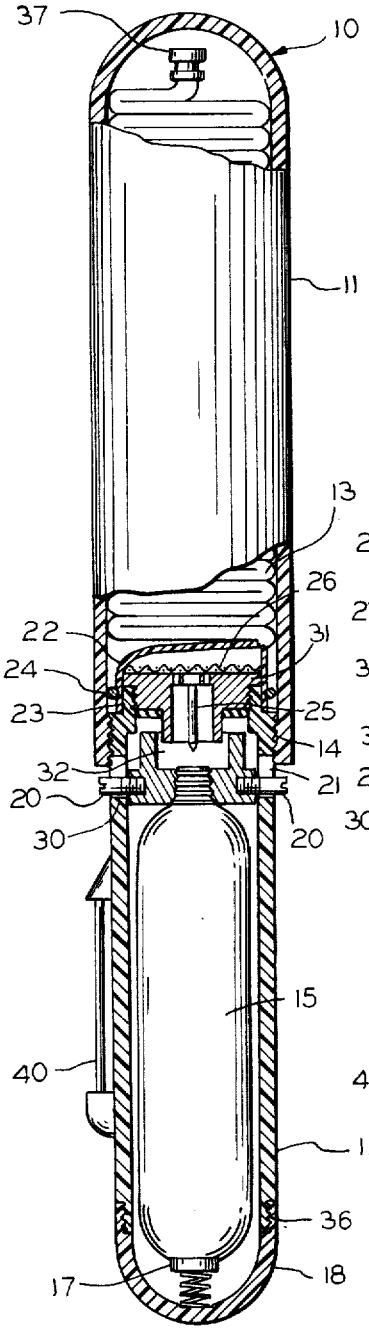
FIG. 1 is an elevation view, partially in cross-section, of the inventive life preserver baton.

In the drawings, the numeral 10 identifies an elongated cylindrical life preserver baton for a person. The baton 10 comprises top 11 and bottom 12 sections coupled by means of the threads 14. The top 11 of the baton 10 functions as a sleeve, closed at one end and open at the other end for receiving a folded, deflated flotation collar 13. Said flotation collar is fashioned from a light, durable material which can be maintained for long periods of time in a folded condition without weakening, mildewing, rotting, or in any way decomposing. The material will be of a highly visible color, such as International Orange, Scarlet Munsell Red, and the like. The top 11 may also be attached to the bottom 12 by any other suitable mating means. By way of example, a thread may be used similar to that found on a safety cap for pharmaceutical bottles containing aspirin, or the like, wherein the cap is removed by simultaneously pressing it down and rotating it.

The baton 10 is a floating device, with the top 11 containing the deflated flotation collar 13, and the bottom 12 containing a gas container 15. The flotation collar 13 is received within the top 11 in a folded and deflated condition, and is freed when the top 11 is removed.

According to my invention, the flotation collar 13 contained in the top 11 is inflated by gas housed in the gas container 15 in the bottom of the baton 10. More particularly, the gas container 15 is contained within the bottom 12 of the device 10. The gas container 15 is stabilized within the bottom 12 by stabilizer means, including a spring 16 and a rubber cup 17 located in the base 18 of the device.

Spring 16 and rubber cup 17 seat, level and maintain a suitable force urging the gas container 15 upwardly as viewed in FIG. 1. When released, the spring 16 pushes the gas container into a piercing means 25 after the top 11 is removed. The sealing collar 19, secured by the threaded plugs 20, prevents the gas container 15 from moving from side to side.

Figure 3:
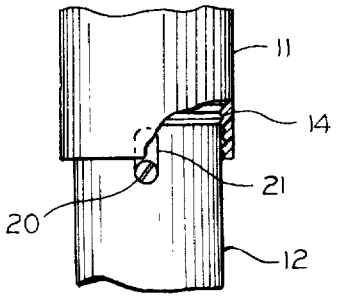
FIG. 3 is a partial perspective view of the top and bottom portions.

Said plugs 20 are received by the collar 19 in sockets 19a through slots 21 formed in the upper portion of bottom 12, as shown in FIG. 3. Slots 21 are elongated in shape to allow sealing collar 19 to be urged upward by spring 16 to a point where the frangible seal 28 contacts piercing means 25.

Attached between the flotation collar 13 and the gas container 15 is the connecting neck 22 of the flotation collar 13. The connecting neck 22 is permanently attached onto the neck 23 of housing bottom 12 and secured in place, for example, by a clamp 24. Cement may also be used between necks 22 and 23.

The connecting neck 23 is a sleeve shaped device with a piercing means 25 disposed on one side of the neck 22, and an air filter 26 attached on the oppositely disposed side of the neck 22. The piercing means 25 extends from the neck 23 and is disposed with the point thereof facing toward the frangible seal 28 of the gas container 15. The air filter 26 is on the opposite side of neck 23 and is interposed before flotation collar 13. The parts housed within or associated with the connecting neck may be referred to as the central mechanism of the baton.

To prevent the accidental piercing of the frangible seal 28, sealing collar 19 acts as a restraining device. Gas container 15 is provided with threaded neck 15*a* and is received by socket 19*b*, threaded to accept neck 15*a*. When placed into bottom 12 and seated against spring 16 and rubber seat 17, the gas-container-and-collar-assembly is further secured by threaded plugs 20 which are received through elongated slots 21 by threaded sockets 19*a* in collar 19. As top 11 is screwed onto bottom 12, shoulder 29 on top 11 engaged threaded plugs 20, forcing them downward to the lower portions of slots 21. When threaded plugs 20 come to rest on lower edge 30 of slots 21, the life preserver baton is fully assembled. Thereafter, sealing collar 19 prevents the gas container 15 from approaching the piercing means 25 to preclude premature inflation. The piercing means 25 is either integral with or firmly held by piercing plug 31 which is threadably or otherwise firmly fastened to connecting neck 23 of bottom 12. Aperture 32 in sealing collar 19 allows piercing plug 31 to slidingly cooperate with sealing collar 19. As top 11 is unscrewed from bottom 12, shoulder 29 releases threaded plugs 20, allowing spring 16 to urge gas container 15 toward piercing means 25, and allowing sealing collar 19 to slide toward piercing plug 31 until piercing means 25 ruptures frangible seal 28, allowing the inflating gas to escape into chamber 33 of piercing plug 31 and thence through apertures 34 into flotation collar 13. Rubber gasket 35, mounted concentrically upon the lowermost portion of piercing plug 31 serves to cushion the impact of sealing collar 19 upon piercing plug 31 when top 11 is removed, and forms a seal, preventing gas from entering bottom 12. To prevent any foreign matter from entering the flotation collar 13, air filter 26 is extended across piercing plug 31 to cover apertures 34.

Figure 5:
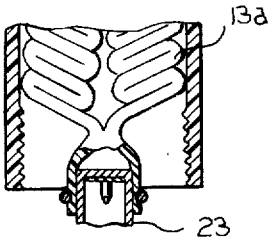
FIG. 5 is a first stop motion view of the folded flotation collar before removal of the top cover.
Figure 6:
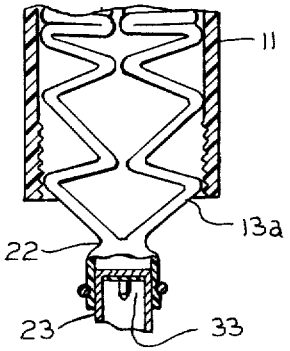
FIG. 6 is a second stop motion view showing how the collar unfolds as the cover is removed, to preclude inflation of the flotation collar while it is still in the top section.

There is no danger of the top 11 being captured by the inflation flotation collar 13. The gas is not able to circulate through the tightly folded bights of the deflated collar before the collar is completely removed from top 11. More particularly, as shown in FIGS. 5 and 6, the tight bights 13a are removed when the top 11 is pulled upwards, thereby allowing the flotation collar 13 to unfold.

In operation, the life preserver baton 10 may be carried in a pocket or secured to a person's clothing, as by the attachment means 40, here shown by way of example as a safety pin. The device 10 may be secured to a person's clothing in an area near the neck. On inflation, the flotation collar 13 is therefore easily adjusted around the neck without any waste of motion or effort.

To properly assemble the life preserver, base 18, threadably fastened to bottom 12 by threads 36, is removed, and sealing collar 19 is inserted and guided into proper position at neck 23. Threaded sockets 19*a* are then aligned with elongated slots 21, and threaded plugs 20 are then inserted through slots 21 into threaded sockets 19*a*. Piercing plug 31 with rubber gasket 35 mounted thereon is then fastened to neck 23 taking care to assure that collar 19 slidably engages piercing plug 31.

Flotation collar 13 is then folded and inserted into top 11, with alternate inflation plug 37 situated at the closed, curved end of top 11. Connecting neck 22 of flotation collar 13 together with air filter 26, is then permanently attached onto bottom 12 by being slipped on over neck 23 and secured in place by clamp 24,or other suitable sealing means. Top 11 is then screwed

24, or onto bottom 12. In this position, shoulder 29 of top 11 has engaged threaded plugs 20 and forced them to the lower edges 30 of the slots 21, assuring that threaded aperture 19*b* is held at its furthest distance from piercing means 25.

Gas container 15 is then inserted into bottom 12 and threaded firmly into aperture 19*b* so that frangible seal 28 is positioned directly upon the axis of travel of piercing means 25. Spring 16 and rubber cup 17 are then placed in base 18, and base 18 is then threaded onto threads 36 of bottom 12, completing assembly of the life saving baton 10.

In event of an emergency, the top 11 is removed from the bottom 12. Upon removal of the top, the spring 16 urges the gas container 15 towards the piercing means 25. At the same time, the threaded plugs 20 of collar 19 are released from engagement with shoulder 29, as the top 11 is removed. Simultaneously, gas container 15 is urged upwards and the frangible seal 28 is ruptured by piercing means 25. To prevent leakage of gas out of the gas container 15 into the bottom 12, the rubber gasket 35 is provided.

Figure 4:
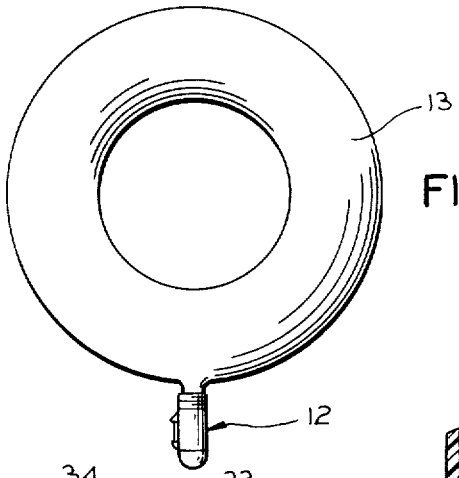
FIG. 4 is a plan view of the life preserver baton with the flotation collar inflated and the bottom section attached.
Figure 2:
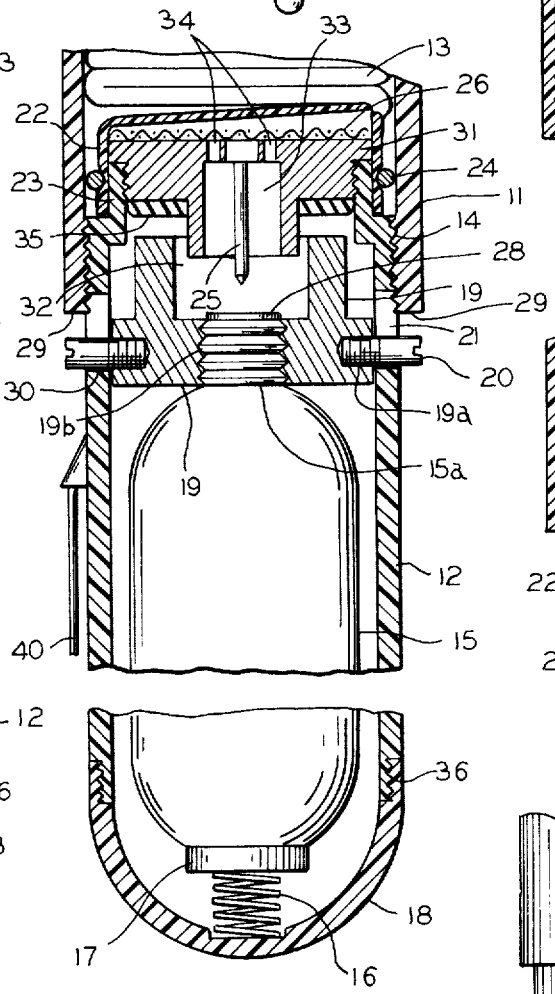
FIG. 2 is an enlarged view of the bottom portion of the life preserver baton.

Once the frangible seal is pierced, the gas is released into the flotation collar 13. As the collar inflates, the bights 13*a* in the folded collar 13 within the top 11, prevent any significant passage of gas into the portions of the collar remaining inside top 11. As the top 11 continues to pass over and release the flotation collar 13, the bights fall away, as shown in FIG. 6, the bights 13*a* opening and the collar 13 inflating. The top 11 is not captured by the inflation of the folded collar. After the top 11 is completely removed, the flotation collar 13 continues inflating until all gas pressure equalizes. The released gas enters neck 22 of the folded flotation collar 13, and inflates the collar to a doughnut shape as shown in FIG. 4. The flotation collar 13 remains permanently attached to the bottom 12 of the baton, and is not removed on inflation. An emergency valve 37 is provided on flotation collar 13 to serve as an alternate inflating means should the gas system, for any reason whatsoever, fail to inflate the flotation collar.

The many advantages of this life preserver baton are self-apparent. The convenient size and ease of operation of the device provides a wide range of applications.

First, on ocean going vessels or any other boat, stored life preserving apparatus is expensive, usually is an eye-sore, and storage represents a serious space problem. With the life preserver baton, these problems are diminished. Hundreds, even thousands of devices could be kept in decorative boxes throughout the boat without storage problems and at no great expense.

Second, as a safety measure, each passenger boarding a boat could easily be given such device with a minimum of delay. The inherent problems of bulk and appearance are eliminated and the passengers have an adequate life preserving means. As with airline safety belts, simple and fast instructions as to use could be given over a public address system before the boat leaves the dock.

Third, the use and application of this device as a means of saving lives in the water could be very widespread. By way of example, skin divers, life guards and swimmers could easily carry the compactly folded device, and thereby enjoy an added measure of safety. The life guard could either carry or throw such an inventive device to a person in distress intead of using a large, bulky, difficult to manipulate life preserver. A skin diver could use the device under water and thereby either float material to the water surface or indicate his position. Of course, there are still other uses which will be apparent to those skilled in the art.

While the principles of the invention have been described above in connection with specific apparatus and applications, it is to be understood that this description is made only by way of example and not as a limitation on the scope of the invention.

I claim:

1. A life preserver device for persons, said device comprising:

container means, said container means having a top section and a bottom section normally coupled together, said bottom section having a base, said top section being removably coupled to said bottom section;

a flotation collar, said flotation collar being received by said top section in a folded, deflated attitude;

sealed gas container means, said gas container means being received by said bottom section;

a connecting neck, said neck extending between said gas container means and said flotation collar, whereby gas released from said gas container fills and inflates said flotation collar, said gas container means having frangible seal means at said connecting neck;

piercing means, said piercing means adapted to pierce said frangible seal means;

stabilizer means, said stabilizer means being adapted to stabilize said gas container means within said bottom section and to urge said gas container means towards said piercing means; and restraining means, said restraining means being adapted to prevent contact between said frangible seal means and said piercing means, said restraining means being defeatable responsive to the uncoupling of said top section from said bottom section.

2. The apparatus as recited in claim 1, wherein said restraining means comprises a sealing collar, said collar being held in place by means contacted by said top section, said collar being locked in place by the coupling of said top section to said bottom section, whereby contact between said piercing means and said frangible seal means is prevented.

3. The apparatus as recited in claim 1, wherein:

said stabilizer means includes spring means and cup means, said spring means and said cup means disposed in said bottom section between said gas container and said base, said spring means urging said gas container toward said piercing means, said stabilizer means and said sealing collar aligning said frangible seal means with said piercing means.

4. The apparatus as recited in claim 1, wherein said piercing means is disposed on one side of said connecting neck, and an air filter is disposed on the opposite side of said connecting neck whereby foreign matter is prevented from entering said flotation collar.

5. The apparatus as recited in claim 1, wherein:

said flotation collar is held in said top section in a tightly bighted attitude, whereby inflation of said flotation collar is deterred until said flotation collar is completely removed from said top section.

6. The apparatus as recited in claim 1, wherein said connecting neck further comprises gasket means, said gasket means being disposed toward said sealing collar, whereby said sealing collar and said gasket means form a substantially gas-tight passage when said restraining means is defeated responsive to uncoupling of said top section from said bottom section.

7. The apparatus as recited in claim 1, wherein:

said piercing means comprises a piercing plug upon which is permanently mounted a spike, said piercing plug being disposed between said restraining means and said flotation collar, said piercing plug being threadably insertable and removable from said life preserver device, said piercing plug having formed therein gas apertures to direct inflating gas into said flotation collar.

8. A life preserver device for persons, comprising:

housing means, said housing means having a top section and a bottom section normally coupled together, inflatable collar means, said inflatable collar means being held in said top section in a folded, deflated attitude;

pressurized gas container means, said gas container means positioned in said bottom section, said pressurized gas container means inflatably connected to said collar means;

inflating means, said inflating means including restraining means, said restraining means being adapted to prevent inflation of said collar means while said top section is coupled to said bottom section, said restraining means being defeated by uncoupling said top section from said bottom section and, means for preventing said collar means from being captured in said top section while said collar is being inflated.

9. The apparatus as recited in claim 8, wherein said capture preventing means comprises tightly folded bights in said collar means which do not open sufficiently to enable gas to pass into said collar until after said bights escape from said top section.

10. The apparatus as recited in claim 5, wherein said inflating means further comprises air filter means positioned to prevent foreign matter from entering said flotation collar during inflation.

11. The apparatus as recited in claim 8, wherein said restraining means comprises a sealing collar, said collar being releasably held by means contacting said top section, said sealing collar thereby preventing inflation of said collar means while said top section is coupled to said bottom section.

* * * * *